US010873804B2

(12) United States Patent
Gomes et al.

(10) Patent No.: US 10,873,804 B2
(45) Date of Patent: Dec. 22, 2020

(54) REINFORCED ACTUATORS FOR DISTRIBUTED MODE LOUDSPEAKERS

(71) Applicant: Google LLC, Mountain View, CA (US)

(72) Inventors: Rajiv Bernard Gomes, San Jose, CA (US); Mark William Starnes, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/289,592

(22) Filed: Feb. 28, 2019

(65) Prior Publication Data

US 2020/0280798 A1 Sep. 3, 2020

(51) Int. Cl.

| | |
|---|---|
| ***H04R 9/06*** | (2006.01) |
| ***H04R 1/28*** | (2006.01) |
| ***H04R 7/04*** | (2006.01) |
| ***H04R 9/02*** | (2006.01) |

(52) U.S. Cl.

CPC ..... *H04R 1/288* (2013.01); *H04R 1/2803* (2013.01); *H04R 7/045* (2013.01); *H04R 9/025* (2013.01); *H04R 9/06* (2013.01); *H04R 2400/11* (2013.01); *H04R 2499/11* (2013.01)

(58) Field of Classification Search

CPC ..... H04R 1/288; H04R 1/2803; H04R 7/045; H04R 9/06; H04R 9/025; H04R 2400/11; H04R 2499/11

See application file for complete search history.

(56) References Cited

U.S. PATENT DOCUMENTS 6,332,029 B1 * 12/2001 Azima ..... B42D 15/022 381/152
2002/0057522 A1 5/2002 Bernett et al.
2018/0124520 A1 5/2018 Schoeffmann et al.

FOREIGN PATENT DOCUMENTS

| | | |
|---|---|---|
| JP | 2008252878 | 10/2008 |
| JP | 2013030846 | 2/2013 |
| WO | WO 2013/047017 | 4/2013 |

OTHER PUBLICATIONS

English Translation of Japanese Patent Publication 2013-030846.*
English Translation of Japanese Patent Publication 2008-252878.*
PCT Invitation to Pay Additional Fees, and Where Applicable, Protest Fee in International Appln. No. PCT/US2019/061824, dated Jan. 31, 2020, 11 pages.

(Continued)

*Primary Examiner* — Brian Ensey
(74) *Attorney, Agent, or Firm* — Fish & Richardson P.C.

(57) ABSTRACT

A panel audio loudspeaker includes a panel extending in a plane. The panel audio loudspeaker includes an actuator attached to the panel. The actuator includes a rigid frame attached to a surface of the panel, the rigid frame including a portion extending perpendicular to the panel surface. The actuator also includes an elongate flexure attached at one end the frame, the flexure extending parallel to the plane. The actuator includes one or more tabs. The actuator includes an electromechanical module attached to a portion of the flexure, the electromechanical module being configured to displace an end of the flexure. The actuator includes a vibration damping material located between each of the one or more tabs and a corresponding feature of the frame or the electromechanical module. One or more of the tabs can engage either the rigid frame or the electromechanical module to damp the vibrations.

19 Claims, 6 Drawing Sheets

(56) References Cited

OTHER PUBLICATIONS

PCT International Search Report and Written Opinion in International Appln. No. PCT/US2019/061824, dated Mar. 24, 2020, 18 pages.
EP Office Action in European Appln. No. 19818381.6, dated Oct. 12, 2020, 8 pages.

* cited by examiner

REINFORCED ACTUATORS FOR DISTRIBUTED MODE LOUDSPEAKERS

BACKGROUND

This specification relates to distributed mode actuators (DMAs), electromagnetic (EM) actuators, and distributed mode loudspeakers that feature DMAs and EM actuators.

Many conventional loudspeakers produce sound by inducing piston-like motion in a diaphragm. Panel audio loudspeakers, such as distributed mode loudspeakers (DMLs), in contrast, operate by inducing uniformly distributed vibration modes in a panel through an electro-acoustic actuator. Typically, the actuators are piezoelectric or electromagnetic actuators.

DMLs can be implemented in a mobile device such as a mobile phone. However, mobile devices are typically subject to more environmental hazards than other devices. For example, a user of the mobile device may drop the device, causing it to impact a surface. A force caused by the impact can damage the components of the mobile device, including components of the DML.

SUMMARY

The disclosed DMAs and EM actuators feature improvements that help to mitigate the risk of the actuators being damaged by unwanted vibrations. Specifically, one or more moving components of the actuators include a tab (or tabs) that extend from an edge of the component and engage a vibration damping material when certain unwanted vibrational modes are excited. For other vibrations, particularly those excited during use of the actuator, there is little or no engagement of the vibration damping material. In this way, unwanted modes are heavily damped while normal operation of the actuators is unaffected. In some embodiments, the tabs and damping materials are arranged to reduce vibrations associated with forces experienced by the actuator due to impacts from being dropped.

In general, in a first aspect, the invention features a panel audio loudspeaker, that includes a panel extending in a plane. The panel audio loudspeaker also includes an actuator attached to the panel and configured to couple vibrations to the panel to cause the panel to emit audio waves. The actuator includes a rigid frame attached to a surface of the panel, the rigid frame including a portion extending perpendicular to the panel surface. The actuator also includes an elongate flexure attached at one end to the portion of the frame extending perpendicular to the panel surface, the flexure extending parallel to the plane. The actuator further includes one or more tabs extending from an edge of the elongate flexure parallel to the plane. The actuator also includes an electromechanical module attached to a portion of the flexure unattached to the frame, the electromechanical module being configured to displace an end of the flexure that is free of the frame in a direction perpendicular to the surface of the panel during operation of the actuator. The actuator further includes a vibration damping material located between each of the one or more tabs and a corresponding feature of the frame or the electromechanical module for receiving the tab. For certain vibrations of the electromechanical module, one or more of the tabs engage either the rigid frame or the electromechanical module through the vibration damping material sufficient to damp the vibrations.

Implementations of the panel audio loudspeaker can include one or more of the following features and/or one or more features of other aspects. For example, the vibrations of the electromechanical module damped by engagement of the tabs with either the rigid frame or the electromechanical module include non-operational vibration modes of the actuator. The non-operational modes of the actuator can include modes caused by a force on the actuator having a component parallel to the plane. The non-operational modes of the actuator can include modes caused by dropping the panel audio loudspeaker.

In some implementations, a piece of the vibration damping material is attached to each tab. In other implementations, the vibration damping material is attached to the frame or the electromechanical module. In some implementations, the vibration damping material is a foam.

In some implementations, the one or more tabs are integral with the elongate flexure.

In some implementations, the elongate flexure is formed from a metal or alloy.

In some implementations, the actuator further includes a beam that includes the elongate flexure and the electromechanical module, and the frame includes a stub to which the beam is anchored at one end. The stub can include a slot for receiving an end of the elongate flexure to anchor the beam.

In some implementations, the electromechanical module includes one or more layers of a piezoelectric material supported by the elongate flexure. The elongate flexure can extend from the stub in a first direction parallel to the plane and at least one of the tabs extends from an edge of the elongate flexure in a second direction perpendicular to the first direction and parallel to the plane.

In some implementations, at least one of the tabs extends from an end of the elongate flexure opposite the end anchored to the stub.

In some implementations, the actuator includes a magnet and a voice coil forming a magnetic circuit. In some implementations, the electromagnetic module includes the magnet and the voice coil is rigidly attached to the frame. In other implementations, the electromagnetic module includes the voice coil and the magnet is rigidly attached to the frame.

In some implementations, the rigid frame includes a panel extending parallel to the plane and at least one pillar extending perpendicular to the plane and the elongate flexure is attached to the pillar.

In some implementations, the elongate flexure includes a first portion extending parallel to the plane and a second portion extending perpendicular to the plane, the second portion being affixed to the pillar to attach the elongate flexure to the frame. The elongate flexure can include a sheet of a material bent to form the first and second portions and each portion includes a tab extending from an edge of the elongate flexure towards the electromagnetic module. In some embodiments, the elongate flexure is attached to the electromagnetic module at an end opposite an end of the elongate flexure attached to the pillar.

In some implementations, the panel includes a display panel.

Among other advantages, when compared to conventional actuators, embodiments include actuators that have a decreased chance of failure caused by unwanted vibrations, e.g., vibrations generated by the actuators being dropped.

Other advantages will be evident from the description, drawings, and claims.

BRIEF DESCRIPTION OF THE DRAWINGS

Like reference symbols in the various drawings indicate like elements.

DETAILED DESCRIPTION

The disclosure features actuators for panel audio loudspeakers, such as distributed mode loudspeakers (DMLs). Such loudspeakers can be integrated into a mobile device, such as a mobile phone. For example, referring to FIG. 1, a mobile device 100 includes a device chassis 102 and a touch panel display 104 including a flat panel display (e.g., an OLED or LCD display panel) that integrates a panel audio loudspeaker. Mobile device 100 interfaces with a user in a variety of ways, including by displaying images and receiving touch input via touch panel display 104. Typically, a mobile device has a depth of approximately 10 mm or less, a width of 60 mm to 80 mm (e.g., 68 mm to 72 mm), and a height of 100 mm to 160 mm (e.g., 138 mm to 144 mm).

Mobile device 100 also produces audio output. The audio output is generated using a panel audio loudspeaker that creates sound by causing the flat panel display to vibrate. The display panel is coupled to an actuator, such as a DMA or EM actuator. The actuator is a movable component arranged to provide a force to a panel, such as touch panel display 104, causing the panel to vibrate. The vibrating panel generates human-audible sound waves, e.g., in the range of 20 Hz to 20 kHz.

In addition to producing sound output, mobile device 100 can also produces haptic output using the actuator. For example, the haptic output can correspond to vibrations in the range of 180 Hz to 300 Hz.

Figure 1:
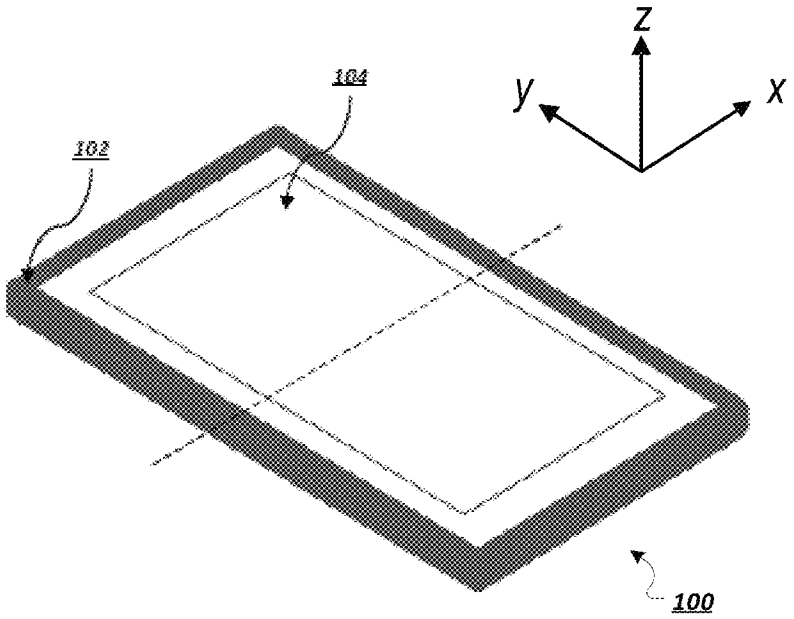
FIG. 1 is a perspective view of an embodiment of a mobile device.
Figure 2:
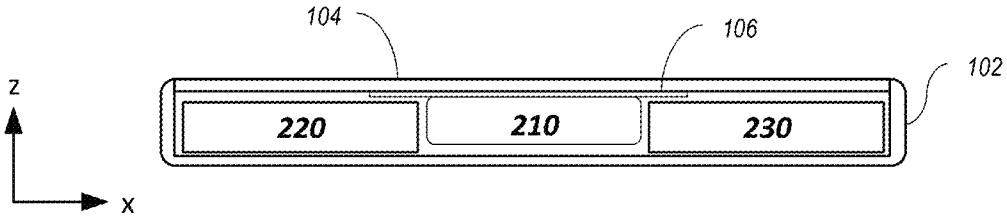
FIG. 2 is a schematic cross-sectional view of the mobile device of FIG. 1.

FIG. 1 also shows a dashed line that corresponds to the cross-sectional direction shown in FIG. 2. Referring to FIG. 2, a cross-section of mobile device 100 illustrates device chassis 102 and touch panel display 104. FIG. 2 also includes a Cartesian coordinate system with x, y, and z axes, for ease of reference. Device chassis 102 has a depth measured along the z-direction and a width measured along the x-direction. Device chassis 102 also has a back panel, which is formed by the portion of device chassis 102 that extends primarily in the xy-plane. Mobile device 100 includes an actuator 210, which is housed behind display 104 in chassis 102 and affixed to the back side of display 104. Generally, actuator 210 is sized to fit within a volume constrained by other components housed in the chassis, including an electromechanical module 220 and a battery 230.

In general, actuator 210 includes a frame that connects the actuator to display panel 104 via a plate 106. The frame serves as a scaffold to provide support for other components of actuator 210.

The electromechanical module is typically a transducer that transforms electrical signals into a mechanical displacement. At least a portion of the electromechanical module is usually rigidly coupled to the flexure so that when the electromechanical module is energized, the module causes the flexure to vibrate.

Generally, actuator 210 is sized to fit within a volume constrained by other components housed in mobile device 100, including electronic control module 220 and battery 230. Actuator 210 can be one of a variety of different actuator types, such as an electromagnet actuator or a piezoelectric actuator.

Figure 3A:
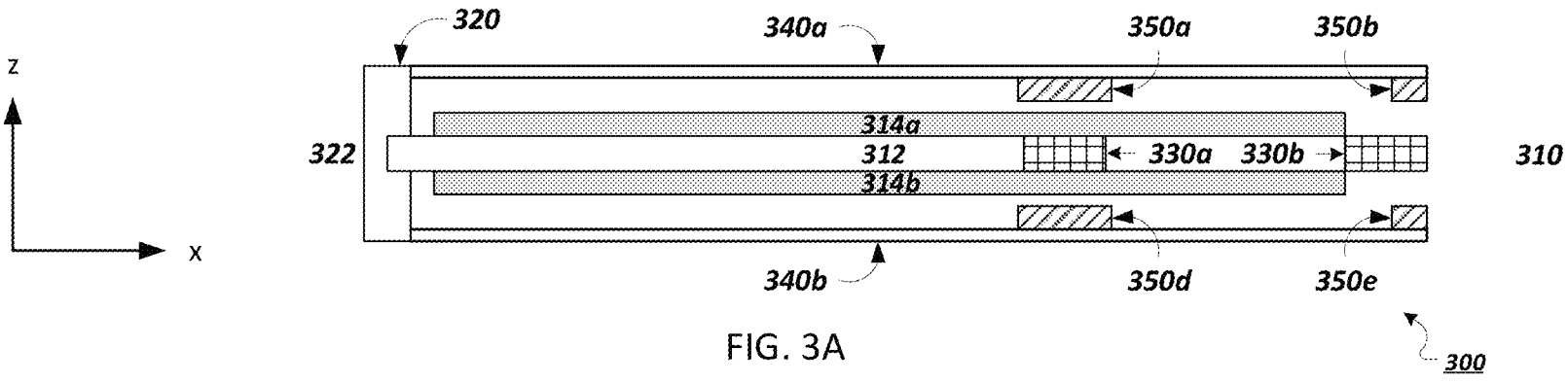
FIG. 3A is a cross-sectional view of a DMA.
Figure 3B:
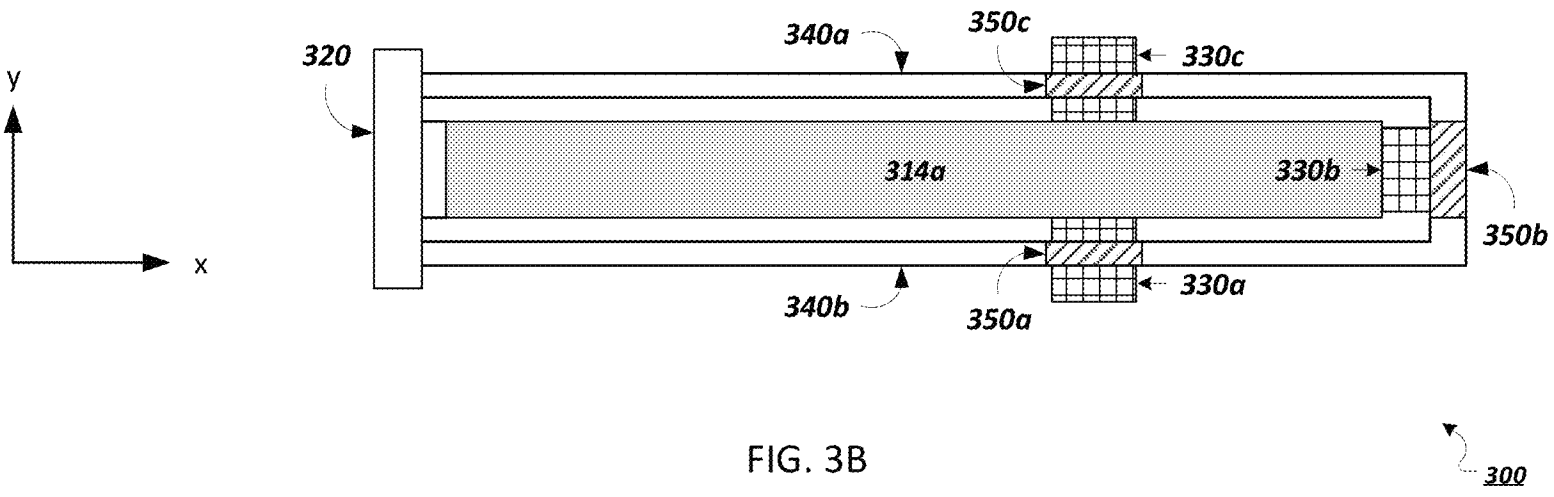
FIG. 3B is a top view of the DMA of FIG. 3A.

Turning now to specific embodiments, in some implementations the actuator is a distributed mode actuator (DMA). For example, FIGS. 3A and 3B show different views of a DMA 300, which includes a beam 310 attached to a frame 320. FIG. 3A is a cross-section of DMA 300, while FIG. 3B is a top-view of DMA 300.

Referring specifically to FIG. 3A, in DMA 300, beam 310 includes a vane 312 and piezoelectric stacks 314*a* and 314*b*. Vane 312 is an elongate member that is attached at one end to frame 320, which is a stub that attaches the vane to plate 106. Beam 310 is attached to frame 320 at a slot 322 into which vane 312 is inserted. The height of slot 322, as measured in the z-direction, is approximately equal to the height of vane 312, which can be approximately 0.1 mm to 1 mm, e.g., 0.2 mm to 0.8 mm, such as 0.3 mm to 0.5 mm.

Beam 310 extends from frame 320, terminating at an unattached end that is free to move in the z-direction. In the examples of FIGS. 3A and 3B, piezoelectric stacks 314*a* and 314*b* are disposed above and below vane 312, respectively. Each stack 314*a* and 314*b* can include one or more piezoelectric layers.

DMA 300 also includes tabs 330*a*, 330*b*, and 330*c*, which are formed from vane 312, and shown having a crosshatched pattern. Tabs 330*a* and 330*c* extend from a face of vane 312 that extends perpendicularly to frame 320, while tab 350*b* is connected to a face of vane 312 that is opposite frame 320.

DMA 300 also includes an upper frame 340*a* and a lower frame 340*b*. As illustrated, upper frame 340*a* and lower frame 340*b* are arranged symmetrically about vane 312, although other arrangements are possible (e.g., asymmetric arrangements). Damping members, 350*a*, 350*b*, and 350*c*, are attached to upper frame 340*a* at three locations. Each damping member 350*a*-350*c* is positioned above a tab. Similarly, lower frame 340*b* supports three damping members, which are each positioned below a tab. FIG. 3A shows two damping members 350*d* and 350*e*, which are attached to lower frame 340*b*. Tab 330*a* is positioned between damping members 350*a* and 350*d*, while tab 330*b* is positioned between damping members 350*b* and 350*e*. Damping member 350*c* is positioned above tab 330*c*. While not shown in FIG. 3A or 3B, a damping member 350*f* is positioned below tab 330*c*, such that the damping member is symmetric to damping member 350*c* about vane 312.

In general, the damping members can be any viscoelastic material designed to increase the energy lost on impact with the tab. For example, the damping material can be a foam, e.g., a low-stiffness foam such as 7900 series foam.

When DMA 300 is at rest, beam 310, i.e., vane 312 and piezoelectric stacks 314*a* and 314*b*, remains parallel to the xy-plane. During the operation of DMA 300, piezoelectric stacks 314*a* and 314*b* are energized, causing beam 310 to vibrate relative to the z-axis. The vibration of beam 310 transfers a force to panel 104, causing the panel to vibrate and produce sound waves.

In general, the displacement of beam 310 caused by the operation of DMA 300 is not so large that tabs 330*a*-330*c* engage damping members 350*a*-350*f*. Rather, only certain vibrations cause tabs 330*a*-330*c* to engage damping members 350*a*-350*f* For example, when DMA 300 is implemented in a mobile device, such as mobile device 100, unwanted vibrations generated by the mobile device being dropped may cause beam 310 to be sufficiently displaced to cause tabs 330*a*-330*c* to engage damping members 350*a*-350*f*. The engagement of the tabs allow the force of the unwanted vibrations to be dissipated by the damping members 350*a*-350*f*, therefore, preventing beam 310 from being damaged by the unwanted vibration.

The placement of tabs 330*a*-330*c* and damping members 350*a*-350*f* are chosen so as to optimize (e.g., maximize) the dissipation of unwanted vibrations based on the size and shape of DMA 310. In other implementations, the dimensions of a DMA may warrant positions that are different from those of tabs 330*a*-330*c* and damping members 350*a*-350*f* For example, in some implementations, a DMA can include tabs and damping members on the sides of the DMA that are positioned closer to either the free end of the DMA or the frame 320.

While other implementations may feature different positions of tabs and corresponding damping members than those of DMA 300, the number of tabs can also be chosen so as to optimize the dissipation of unwanted vibrations. For example, while DMA 300 includes three tabs and six damping members, in other implementations, a DMA can include more or less than three tabs and more or less than six damping members.

Other implementations of DMAs can include tabs that are differently shaped than those of DMA 300. For example, while FIGS. 3A and 3B show tabs having rectangular profiles, in other implementations, the tabs can be any shape that allows for unwanted vibrations to be effectively dissipated. Accordingly, in other implementations, the shapes of damping members can be chosen so that corresponding tabs engage the damping members in a way that optimally dissipates unwanted vibrations.

In some implementations, a ring structure can replace one or more of the pairs of damping members. For example, instead of having damping members 350*b* and 350*e* above and below tab 330*b*, the damping members can be replaced by a ring of damping material. That is, the damping material would form a circular shape when viewed from the zy-plane. The damping ring can be attached to upper and lower frames 340*a* and 340*b* at two points along the damping ring that form a diameter line that splits the damping ring into halves. Among other advantages, a DMA that features a damping ring instead of a pair of damping members can be protected from a wider range of dropping angles. That is, because the damping ring forms a circle in the zy-plane, tab 330*b* has 360 degrees of damping material with which to engage.

Tabs 330*a*, 330*b*, and 330*c* can be formed from the same material as vane 312, e.g., the vane and tabs can be one continuous material that is bent into the shape of the tabs. Vane 312 may be formed from any material that can bend in response to the force generated by piezoelectric stacks 314*a* and 314*b*. The material that forms vane 312 should have an elastic limit such that the vane does not show plastic deformation as a result of the bending that occurs during operation of actuator 300. For example, vane 312 can be a single metal or alloy (e.g., iron-nickel, such as NiFe42), a hard plastic, or another appropriate type of material. The materials from which vane 312 and piezoelectric stacks 314*a* and 314*b* are formed should have a low CTE mismatch.

The one or more piezoelectric layers of piezoelectric stacks 314*a* and 314*b* may be any appropriate type of piezoelectric material. For instance, the material may be a ceramic or crystalline piezoelectric material. Examples of ceramic piezoelectric materials include barium titanate, lead zirconium titanate, bismuth ferrite, and sodium niobate, for example. Examples of crystalline piezoelectric materials include topaz, lead titanate, barium neodymium titanate, potassium sodium niobate (KNN), lithium niobate, and lithium tantalite.

While FIGS. 3A and 3B show an embodiment of an actuator that includes piezoelectric stacks that displace a vane, more generally, actuator 210 includes an electromechanical module that displaces a flexure during the operation of the actuator. A flexure is typically an elongate member that extends in the xy-plane, and when vibrating, is displaced in the z-direction. The flexure is generally attached to the frame at at least one end. The opposite end can be free from the frame, allowing the flexure to move in the z-direction as it vibrates.

While in some implementations, actuator 210 is a distributed mode actuator, as shown in FIGS. 3A-3B, in other implementations, the actuator is an electromagnetic (EM) actuator that is attached to panel 104. Like a DMA, an EM actuator transfers mechanical energy, generated as a result of the actuator's movement, to a panel to which the actuator is attached.

Figure 4A:
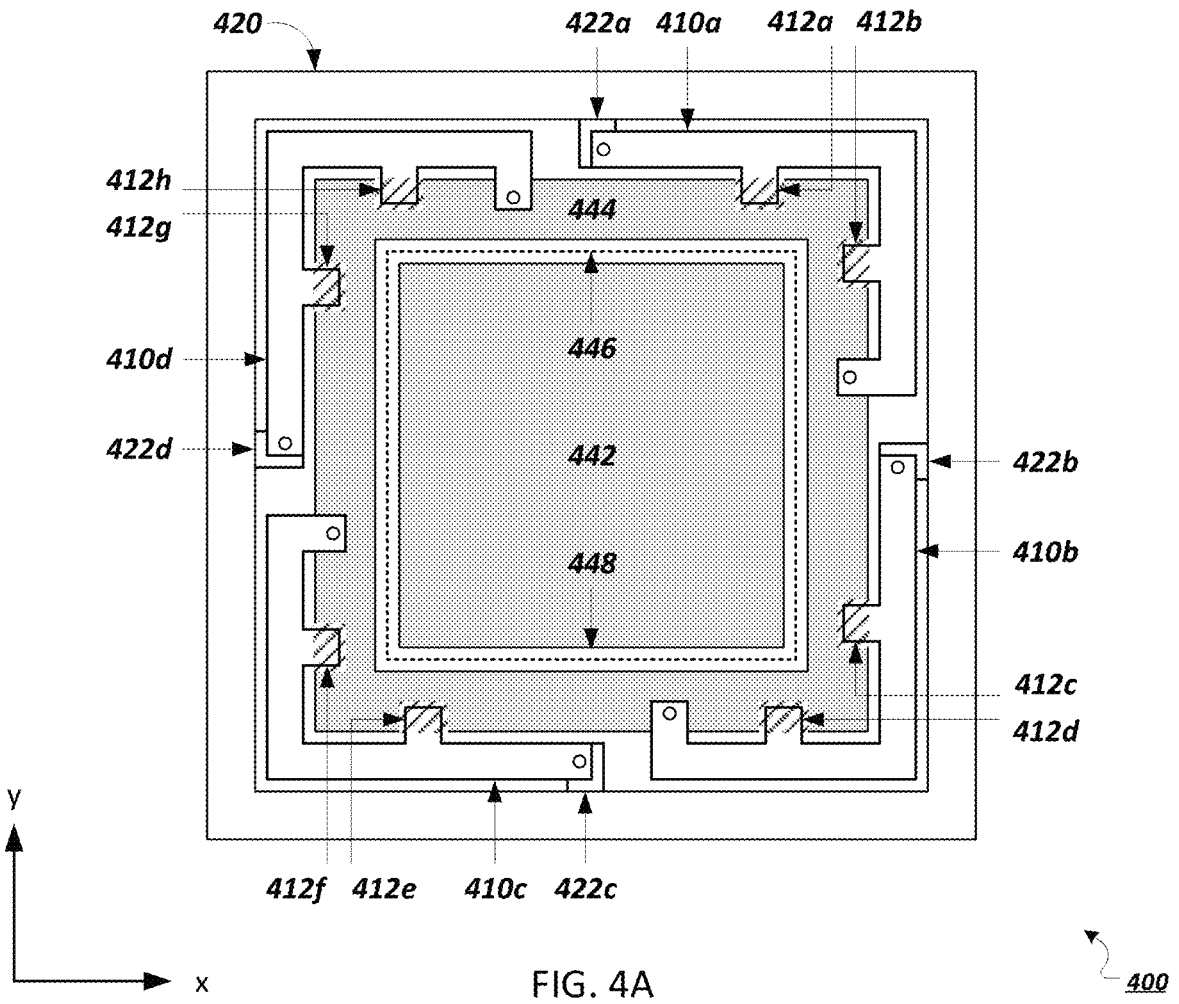
FIG. 4A is a top view of an EM actuator.
Figure 4B:
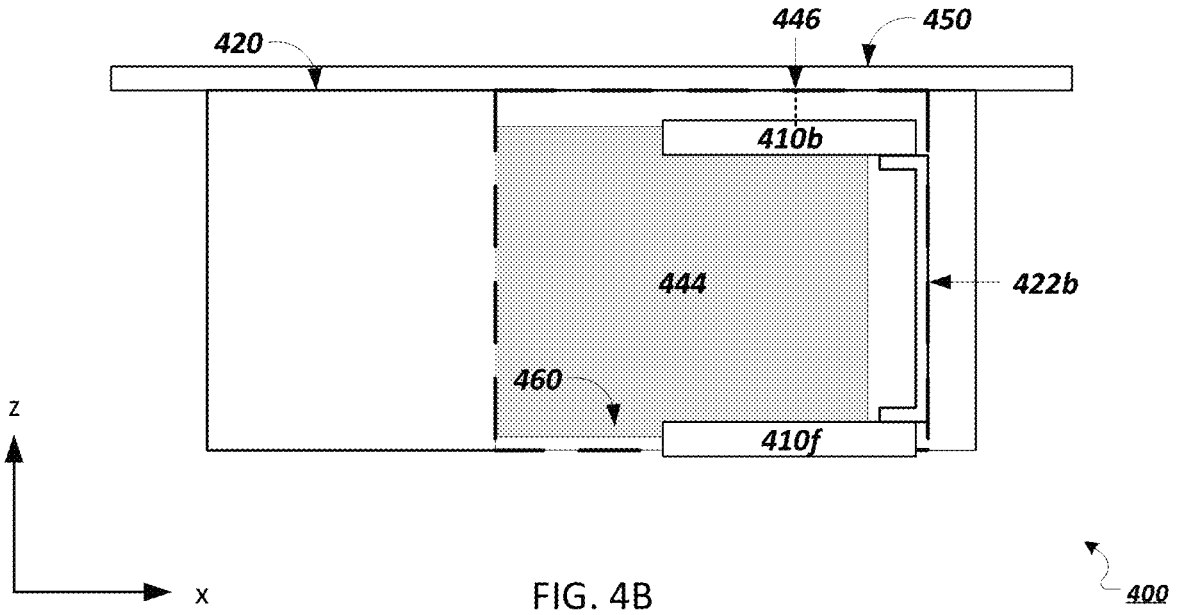
FIG. 4B is a side view of the EM actuator of FIG. 4A.

FIGS. 4A and 4B show an EM actuator 400, which includes a frame 420 that acts as a scaffold to provide support for other components of the actuator, including four flexures that each connected to a different portion of an electromechanical module.

FIG. 4A is a top view of EM actuator 400, which includes four flexures 410*a*-410*d*. Each flexure 410*a*-410*d* is connected to the electromechanical module, which includes an inner magnet 442 and an outer magnet 444. The material chosen to form inner and outer magnets 442 and 444 can be a permanent magnet or soft magnetic material such as iron or an iron alloy.

Between outer magnet 442 and inner magnet 444, is an air gap 448. Although not shown in FIGS. 4A-4C, EM actuator 400 is attached to panel 104.

When viewed in the xy-plane, frame 420 has a square profile that surrounds the electromechanical module. The square profile has an inside edge that faces outer magnet 444. Four pillars labeled 422*a*, 422*b*, 422*c*, and 422*d* are connected to the inside edge of the square portion. Each pillar 422*a*-422*d* is C-shaped, to include both a portion that extends perpendicularly to the xy-plane and two portions that extend parallel to the xy-plane. The portions of pillars 422*a*-422*d* that extends parallel to the xy-plane are connected to frame 420, while the portions that extend perpendicularly to the xy-plane are connected to the inside edge of frame 420.

Flexures 410*a*-410*d* connect frame 420 to outer magnet 444. Locations at which flexures 410*a*-410*d* connect to outer magnet 444 are shown as circles. For example, the flexures can be attached to the pillars using an adhesive, a weld, or other physical bond. In some implementations, the portion of outer magnet 444 at which each flexure 410*a*-410*d* is connected is recessed such that the flexure is flush with outer magnet 444. In other implementations, the recess is deep enough such that the top surface of each flexure is below the top surface of the outer magnet.

While FIG. 4A shows a top view of EM actuator 400, FIG. 4B shows a side view of the actuator. To show certain components of EM actuator 400, a portion of frame 420, is removed in FIG. 4B. The removed portion of frame 420 is enclosed by dashed lines.

While FIG. 4A shows four flexures, 410*a*-410*d*, in addition to these flexures, EM actuator 400 also includes flexures 410*e*-410*h*. Flexures 410*a*-410*d* are attached to a top portion of pillars 422*a*-422*d* that extends parallel to the xy-plane, while flexures 410*e*-410*h* are attached to a bottom portion of the pillars that also extends parallel to the xy-plane. Flexures 410*e*-410*h* are identical in shape to flexures 410*a*-410*d* and are positioned such that they are parallel to flexures 410*a*-410*d*. In some implementations, the flexures that are parallel to one another (e.g., flexures 410*a* and 410*e*, flexures 410*b* and 410*f*, and so on) are formed from one continuous component.

FIG. 4B includes flexure 410*f*, which is positioned below flexure 410*b* and attached to pillar 422*b*. Flexure 410*f* attaches to a bottom plate 460, which is positioned below and attached to inner and outer magnets 442 and 444. While flexures 410*a*-410*d* are attached to outer magnet 444, flexures 410*e*-410*f* are attached to bottom plate 460. Flexures 410*a*-410*h* bend to allow inner magnet 442, outer magnet 444, and bottom plate 460 to move in the z-direction.

FIG. 4B also includes a top plate 450, which forms part of frame 420. Top plate 450 is positioned above inner and outer magnets 442 and 444 and is parallel to bottom plate 460. Top plate 450 is omitted from FIG. 4A so that other components of EM actuator 400 can be shown. In some implementations, plate 106 forms top plate 450.

Figure 4C:
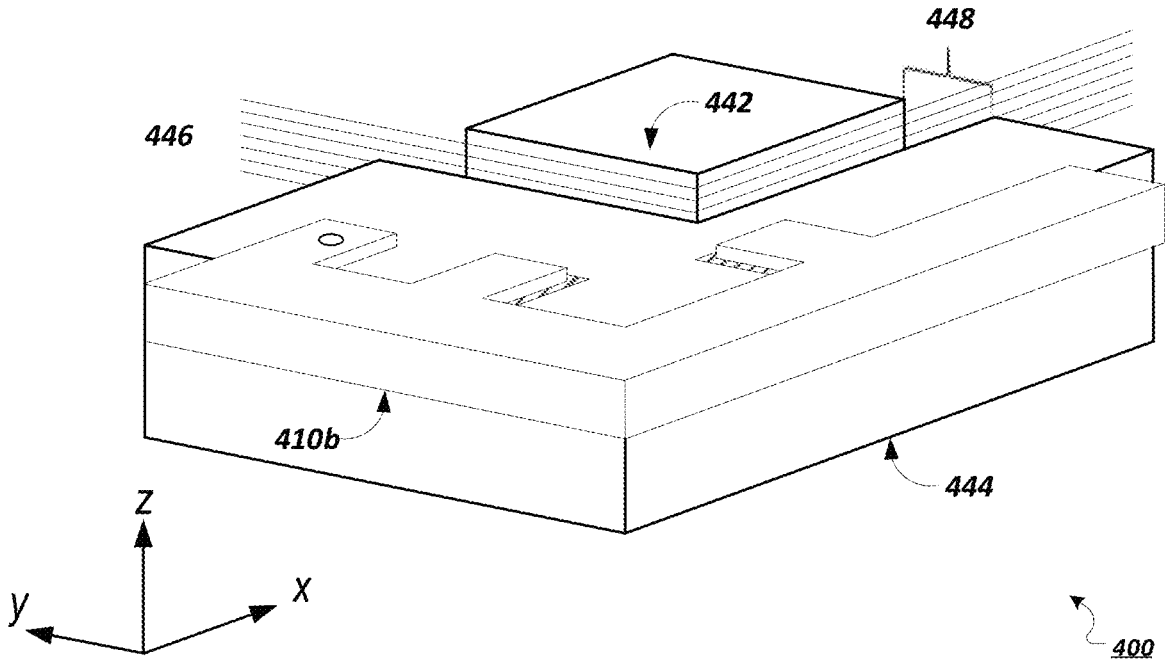
FIG. 4C is a quarter-cut perspective view of the EM actuator shown in FIGS. 4A-4B.

An additional view of EM actuator 400 is shown in FIG. 4C, which is a quarter-cut view of EM actuator 400. FIG. 4C shows flexure 410*b* as well as portions of inner and outer magnets 442 and 444. As mentioned above, between inner and outer magnets 442 and 444, is air gap 448. Referring to FIGS. 4A-4C, a voice coil 446 is positioned in air gap 448 and is attached to top plate 450.

Although in this implementation, EM actuator 400 includes eight pillars, each connected to two of flexures 410*a*-410*h*, in other implementations, the actuator can include more or less than eight flexures.

During the operation of EM actuator 400, voice coil 446 is energized, which induces a magnetic field in air gap 448. Because inner and outer magnets 442 and 444 have an axial magnetic field, parallel to the z-axis, and are positioned in the induced magnetic field, the magnets experience a force due to the interaction of their magnetic fields with that of voice coil 446. Flexures 410*a*-410*h* bend to allow inner and outer magnets 442 and 444 to move in the z-direction, in response to the force experienced by the magnets.

While FIGS. 4A-4C show specific embodiments of an EM actuator, in general, an EM actuator includes an electromechanical module, which in turn includes a magnet and a voice coil that form a magnetic circuit. The EM actuator also includes one or more flexures that attach the electromechanical module to a frame. The frame includes one or more pillars that extend perpendicularly to panel 104. Each of the one or more flexures is attached to a pillar.

Figure 5A:
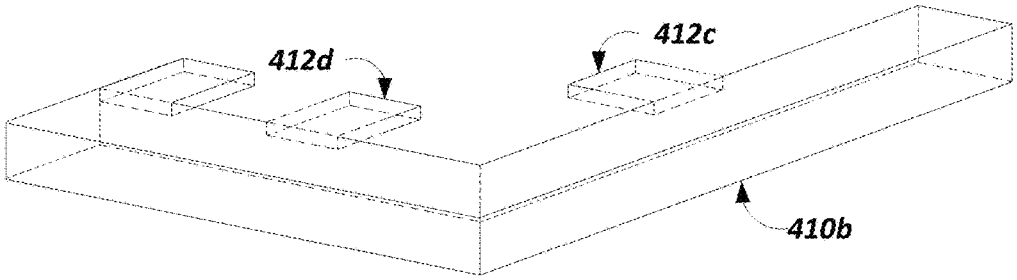
FIG. 5A is a perspective view of a flexure of the EM actuator of FIGS. 4A-4B.
Figure 5B:
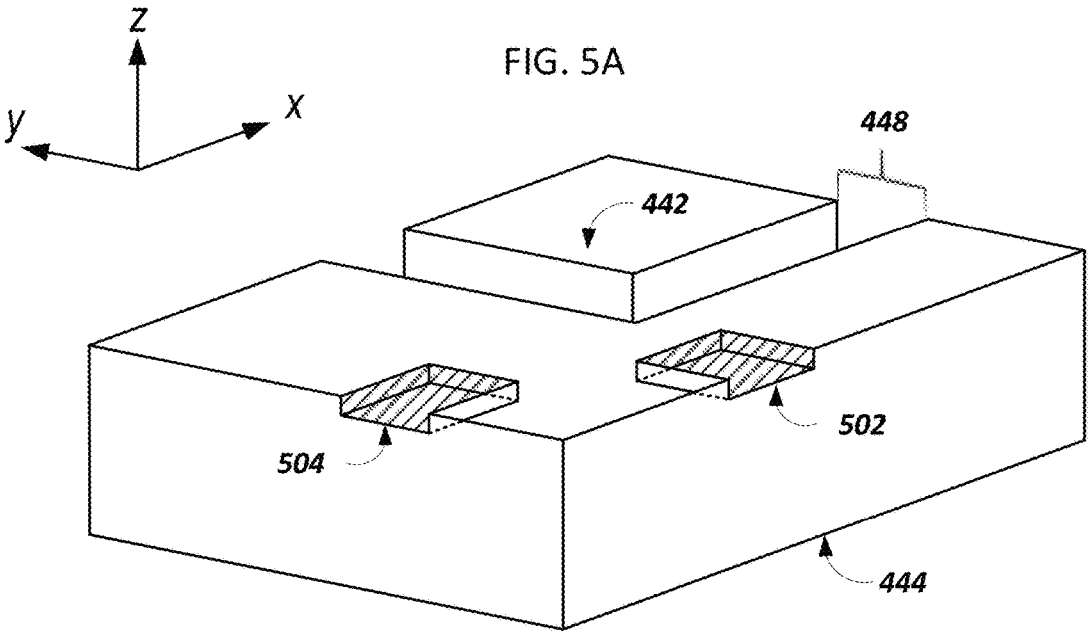
FIG. 5B is a quarter-cut perspective view of the actuator of FIGS. 4A-4B showing features for receiving a tab of the flexure of FIG. 5A.
Figure 5C:
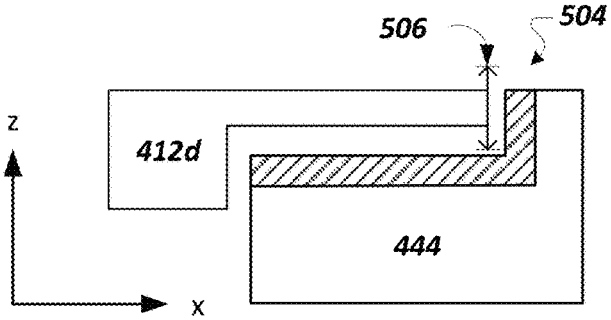
FIG. 5C is a side view of a tab of the flexure of FIG. 5A, showing the tab disengaged from a feature for receiving the tab.

Referring to FIG. 4A, each flexure includes an outer edge that faces frame 420 and an inner edge that faces outer magnet 444. Two tabs extend from the inner edges of each of flexures 410*a*-410*h*. In line with each tab, outer magnet 444 includes a corresponding feature for receiving each of the tabs. The features, shown as diagonally striped rectangles, are recessions into which each tab can fit. Although not shown in FIG. 4A, flexures 410*e*-410*h* also include tabs that extend from the inner edges of each of the flexures. The positions of the tabs and the corresponding features for receiving each of the tabs are shown in FIGS. 5A-5C. Although FIGS. 5A-5C make reference to flexure 410*b*, the discussion of flexure 410*b* extends to the other flexures of EM actuator 400.

FIG. 5A, is a perspective view of flexure 410*b*. As described with regard to FIGS. 4A-4C, one end of flexure 410*b* includes a portion which is connected to outer magnet 444. Flexure 410*b* also includes two tabs, 412*c* and 412*d*, which extend from an edge of the flexure. Referring now to FIG. 5B, a quarter-cut view of EM actuator 400 includes inner magnet 442, outer magnet 444, and air gap 448. Outer magnet 444 includes features 502 and 504, which are sized and shaped to receive tabs 412*c* and 412*d*. Accordingly, the dimensions of tabs 412*c* and 412*d* are smaller than those of features 502 and 504, so that there is a space between each tab and its corresponding feature. Each feature 502 and 504 includes damping material, which is shown by diagonal lines.

Figure 5D:
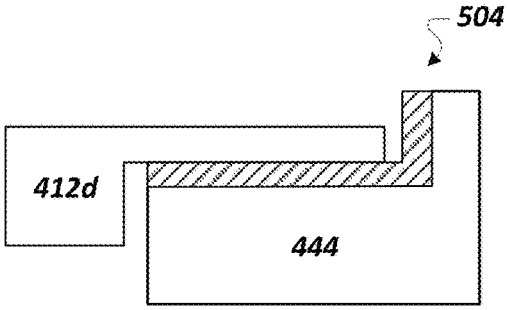
FIG. 5D is a side view of the tab of FIG. 5C, showing the tab engaged with a feature for receiving the tab.

Referring now to FIGS. 5C and 5D, side-views of flexure 410*d* and outer magnet 444 include feature 504 in relation to tab 412*d*. To better show how tab 412*d* engages feature 504, in FIGS. 5C and 5D, the tab is shown as being disconnected from flexure 410*b*. The damping material of feature 504 is shown as diagonal lines.

Referring specifically to FIG. 5C, tab 412*d* is disengaged from feature 504. An arrow 506 shows a range of displacement in the z-direction of tab 412*d* during typical operation of EM actuator 400. As indicated by arrow 506, during typical operation of EM actuator 400, tab 412*d* does not contact the damping material of feature 504.

Referring now to FIG. 5D, tab 412*d* is engaged with feature 504. A portion of tab 412*d* contacts and compresses the damping material of feature 504. In general, the engagement of the tabs and damping materials helps to prevent EM actuator 400 from being damaged as a result of unwanted vibrations. For example, FIG. 5D can correspond to a scenario in which EM actuator 400, or a mobile device that includes EM actuator 400, is dropped. More generally, during the unwanted vibration, at least one of tabs 412*a*-412*h* can engage a corresponding recession of outer magnet 444, therefore dissipating the unwanted vibration. While tabs 412*a*-412*h* serve to dissipate unwanted vibrations, in general, the tabs are fabricated such that during operation of the actuator, the tabs do not contact their corresponding recessions or the damping material positioned inside the recessions.

In some implementations, the damping material can line at least a portion of the space defined by the recession. In other implementations, the damping material can be disposed on one or more faces of each tab. The damping material can be the same material as that which forms the damping members of FIGS. 3A and 3B. In some implementations, the material of inner and outer magnets 442 and 444 is chosen based on the location of tabs 412*a*-412*h*.

Figure 6:
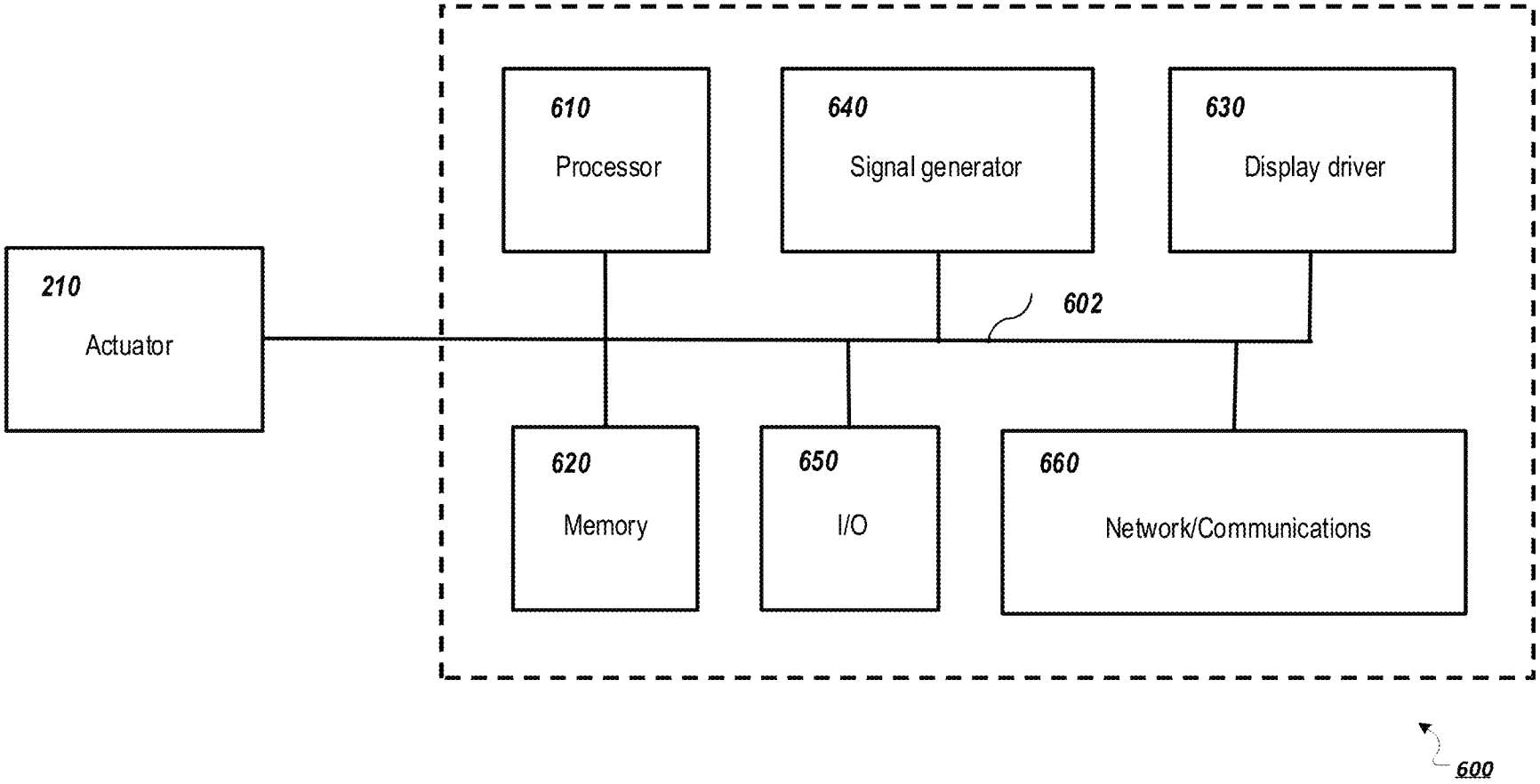
FIG. 6 is a schematic diagram of an embodiment of an electronic control module for a mobile device.

In general, the disclosed actuators are controlled by an electronic control module, e.g., electronic control module 220 in FIG. 2 above. In general, electronic control modules are composed of one or more electronic components that receive input from one or more sensors and/or signal receivers of the mobile phone, process the input, and generate and deliver signal waveforms that cause actuator 210 to provide a suitable haptic response. Referring to FIG. 6, an exemplary electronic control module 600 of a mobile device, such as mobile phone 100, includes a processor 610, memory 620, a display driver 630, a signal generator 640, an input/output (I/O) module 650, and a network/communications module 660. These components are in electrical communication with one another (e.g., via a signal bus 602) and with actuator 210.

Processor 610 may be implemented as any electronic device capable of processing, receiving, or transmitting data or instructions. For example, processor 610 can be a microprocessor, a central processing unit (CPU), an application-specific integrated circuit (ASIC), a digital signal processor (DSP), or combinations of such devices.

Memory 620 has various instructions, computer programs or other data stored thereon. The instructions or computer programs may be configured to perform one or more of the operations or functions described with respect to the mobile device. For example, the instructions may be configured to control or coordinate the operation of the device's display via display driver 630, signal generator 640, one or more components of I/O module 650, one or more communication channels accessible via network/communications module 660, one or more sensors (e.g., biometric sensors, temperature sensors, accelerometers, optical sensors, barometric sensors, moisture sensors and so on), and/or actuator 210.

Signal generator 640 is configured to produce AC waveforms of varying amplitudes, frequency, and/or pulse profiles suitable for actuator 210 and producing acoustic and/or haptic responses via the actuator. Although depicted as a separate component, in some embodiments, signal generator 640 can be part of processor 610. In some embodiments, signal generator 640 can include an amplifier, e.g., as an integral or separate component thereof.

Memory 620 can store electronic data that can be used by the mobile device. For example, memory 620 can store electrical data or content such as, for example, audio and video files, documents and applications, device settings and user preferences, timing and control signals or data for the various modules, data structures or databases, and so on. Memory 620 may also store instructions for recreating the various types of waveforms that may be used by signal generator 640 to generate signals for actuator 210. Memory 620 may be any type of memory such as, for example, random access memory, read-only memory, Flash memory, removable memory, or other types of storage elements, or combinations of such devices.

As briefly discussed above, electronic control module 600 may include various input and output components represented in FIG. 6 as I/O module 650. Although the components of I/O module 650 are represented as a single item in FIG. 6, the mobile device may include a number of different input components, including buttons, microphones, switches, and dials for accepting user input. In some embodiments, the components of I/O module 650 may include one or more touch sensor and/or force sensors. For example, the mobile device's display may include one or more touch sensors and/or one or more force sensors that enable a user to provide input to the mobile device.

Each of the components of I/O module 650 may include specialized circuitry for generating signals or data. In some cases, the components may produce or provide feedback for application-specific input that corresponds to a prompt or user interface object presented on the display.

As noted above, network/communications module 660 includes one or more communication channels. These communication channels can include one or more wireless interfaces that provide communications between processor 610 and an external device or other electronic device. In general, the communication channels may be configured to transmit and receive data and/or signals that may be interpreted by instructions executed on processor 610. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 660 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the electronic device 100 to a mobile phone for output on that device and vice versa. Similarly, the network/communications module 660 may be configured to receive input provided on another device to control the mobile device. For example, an audible alert, visual notification, or haptic alert (or instructions therefore) may be transmitted from the external device to the mobile device for presentation.

The actuator technology disclosed herein can be used in panel audio systems, e.g., designed to provide acoustic and/or haptic feedback. The panel may be a display system, for example based on OLED of LCD technology. The panel may be part of a smartphone, tablet computer, or wearable devices (e.g., smartwatch or head-mounted device, such as smart glasses).

Other embodiments are in the following claims.

What is claimed is:

1. A panel audio loudspeaker, comprising:

a panel extending in a plane;

an actuator attached to the panel and configured to couple vibrations to the panel to cause the panel to emit audio waves, the actuator comprising:

a rigid frame attached to a surface of the panel, the rigid frame comprising a stub extending perpendicular to the panel surface;

a beam anchored at one end to the stub, the beam including:

an elongate flexure attached at one end to the stub of the frame extending perpendicular to the panel surface, the flexure extending in a first direction parallel to the plane; and an electromechanical module attached to a portion of the flexure unattached to the frame, the electromechanical module comprising one or more layers of a piezoelectric material supported by the flexure, the electromechanical module being configured to displace an end of the flexure that is free of the frame in a direction perpendicular to the panel surface during operation of the actuator;

one or more tabs extending from an edge of the elongate flexure parallel to the plane, wherein at least one of the tabs extends from an edge of the elongate flexure in a second direction perpendicular to the first direction and parallel to the plane; and a vibration damping material located between each of the one or more tabs and a corresponding feature of the frame or the electromechanical module for receiving the tab;

wherein for certain vibrations of the electromechanical module, one or more of the tabs engage either the rigid frame or the electromechanical module through the vibration damping material sufficient to damp the vibrations.

2. The panel audio loudspeaker of claim 1, wherein the vibrations of the electromechanical module damped by engagement of the tabs with either the rigid frame or the electromechanical module comprise non-operational vibration modes of the actuator.

3. The panel audio loudspeaker of claim 2, wherein the non-operational modes of the actuator comprise modes caused by a force on the actuator having a component parallel to the plane.

4. The panel audio loudspeaker of claim 2, wherein the non-operational modes of the actuator comprise modes caused by dropping the panel audio loudspeaker.

5. The panel audio loudspeaker of claim 1, wherein the vibration damping material is a foam.

6. The panel audio loudspeaker of claim 1, wherein a piece of the vibration damping material is attached to each tab.

7. The panel audio loudspeaker of claim 1, wherein the vibration damping material is attached to the frame or the electromechanical module.

8. The panel audio loudspeaker of claim 1, wherein the one or more tabs are integral with the elongate flexure.

9. The panel audio loudspeaker of claim 1, wherein the elongate flexure is formed from a metal or alloy.

10. The panel audio loudspeaker of claim 1, wherein at least one of the tabs extends from an end of the elongate flexure opposite the end anchored to the stub.

11. The panel audio loudspeaker of claim 1, wherein the stub comprises a slot for receiving an end of the elongate flexure to anchor the beam.

12. The panel audio loudspeaker of claim 1, wherein the actuator comprises a magnet and a voice coil forming a magnetic circuit.

13. The panel audio loudspeaker of claim 12, wherein the electromechanical module comprises the magnet and the voice coil is rigidly attached to the frame.

14. The panel audio loudspeaker of claim 12, wherein the electromechanical module comprises the voice coil and the magnet is rigidly attached to the frame.

15. The panel audio loudspeaker of claim 1, wherein the panel comprises a display panel.

16. A panel audio loudspeaker, comprising:

a panel extending in a plane;

an actuator attached to the panel and configured to couple vibrations to the panel to cause the panel to emit audio waves, the actuator comprising:

a magnet and a voice coil forming a magnetic circuit;

a rigid frame attached to a surface of the panel, the rigid frame comprising a panel extending parallel to the plane and at least one pillar extending perpendicular to the plane;

an elongate flexure attached at one end to the pillar extending perpendicular to the plane, the flexure extending parallel to the plane;

one or more tabs extending from an edge of the elongate flexure parallel to the plane;

an electromechanical module attached to a portion of the flexure unattached to the frame, the electromechanical module being configured to displace an end of the flexure that is free of the frame in a direction perpendicular to the surface of the panel during operation of the actuator; and a vibration damping material located between each of the one or more tabs and a corresponding feature of the frame or the electromechanical module for receiving the tab;

wherein for certain vibrations of the electromechanical module, one or more of the tabs engage either the rigid frame or the electromechanical module through the vibration damping material sufficient to damp the vibrations.

17. A panel audio loudspeaker, comprising:

a panel extending in a plane;

an actuator attached to the panel and configured to couple vibrations to the panel to cause the panel to emit audio waves, the actuator comprising:

a magnet and a voice coil forming a magnetic circuit;

a rigid frame attached to a surface of the panel, the rigid frame comprising a pillar extending perpendicular to the plane;

an elongate flexure attached at one end to the pillar extending perpendicular to the plane, the flexure comprising a first portion extending parallel to the plane and a second portion extending perpendicular to the plane, the second portion being affixed to the pillar to attach the elongate flexure to the frame;

one or more tabs extending from an edge of the elongate flexure parallel to the plane;

an electromechanical module attached to a portion of the flexure unattached to the frame, the electromechanical module being configured to displace an end of the flexure that is free of the frame in a direction perpendicular to the panel surface during operation of the actuator; and a vibration damping material located between each of the one or more tabs and a corresponding feature of the frame or the electromechanical module for receiving the tab;

wherein for certain vibrations of the electromechanical module, one or more of the tabs engage either the rigid frame or the electromechanical module through the vibration damping material sufficient to damp the vibrations.

18. The panel audio loudspeaker of claim 17, wherein the elongate flexure comprises a sheet of a material bent to form the first and second portions and each portion comprises a tab extending from an edge of the elongate flexure towards the electromechanical module.

19. A panel audio loudspeaker, comprising:

a panel extending in a plane;

an actuator attached to the panel and configured to couple vibrations to the panel to cause the panel to emit audio waves, the actuator comprising:

a magnet and a voice coil forming a magnetic circuit;

a rigid frame attached to a surface of the panel, the rigid frame comprising a pillar extending perpendicular to the plane;

an elongate flexure attached at one end to the pillar of the frame extending perpendicular to the panel surface, the flexure extending parallel to the plane;

one or more tabs extending from an edge of the elongate flexure parallel to the plane;

an electromechanical module attached to an end of the flexure that is unattached to the frame and opposite an end of the flexure attached to the pillar, the electromechanical module being configured to displace an end of the flexure that is free of the frame in a direction perpendicular to the panel surface during operation of the actuator; and a vibration damping material located between each of the one or more tabs and a corresponding feature of the frame or the electromechanical module for receiving the tab;

wherein for certain vibrations of the electromechanical module, one or more of the tabs engage either the rigid frame or the electromechanical module through the vibration damping material sufficient to damp the vibrations.

* * * * *